US006002734A

United States Patent [19]

Steinman

[11] Patent Number: 6,002,734

[45] Date of Patent: Dec. 14, 1999

[54] METHOD AND SYSTEMS FOR GOLD ASSAY IN LARGE ORE SAMPLES

[76] Inventor: Don K. Steinman, 3 Burgundy Rd., Aiken, S.C. 29801

[21] Appl. No.: 08/898,139

[22] Filed: Jul. 22, 1997

[51] Int. Cl.[6] ..... G21G 1/00

[52] U.S. Cl. ..... 376/157

[58] Field of Search ..... 376/157, 202; 250/269.3

[56] References Cited

PUBLICATIONS

Gijbels et al, "Activation Analysis of Ores and Minerals", Pure & Appl. Chem., vol. 49, pp. 1555, 1567–1573, 1977.

Veres, "Gamma activation of nuclear isomers and its applications", Atomic Energy Review, vol. 18, No. 2. pp. 271–328, Jun. 1980.

Tilbury et al, "Activation Analysis by High–Energy Particles", Nucleonics, pp. 70–78, Sep. 1965.

Mancini, "Neutron and Gamma Ray Transmission: Methods and Accuracy for the Analysis of Silver and Gold Alloys", Int. J. Appl. Radiat. Isot., vol. 36, No. 6, pp. 489–494, 1985.

*Primary Examiner*—Daniel D. Wasil

*Attorney, Agent, or Firm*—Gunn & Associates PC

[57] ABSTRACT

A technique for assaying samples entails irradiating a sample with a beam of gamma rays of sufficient energy to excite the nuclei of the assay elements into their isomeric states, ceasing the irradiation, detecting the gamma rays resulting from the decay of the isomeric states to the ground state, and analyzing the detected gamma rays to determine the content of assay elements in the sample. In a preferred embodiment, the apparatus is configured such that the irradiated sample is rapidly moved to a shielded environment in which the gamma rays from the isomeric transitions are detected. The system is ideally suited for analyzing large samples of ore for gold, silver, barium and other assay elements, but can be embodied to detect any assay elements susceptible to photon activation analysis in any sample geometry.

28 Claims, 3 Drawing Sheets

TROLLEY MOTOR & CONTROL
SAMPLE POSITION CONTROL
LINAC
T
C
D
ELECTRONICS

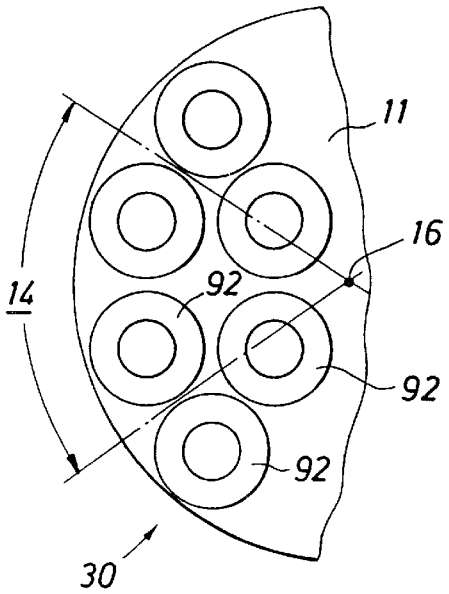
FIG. 3
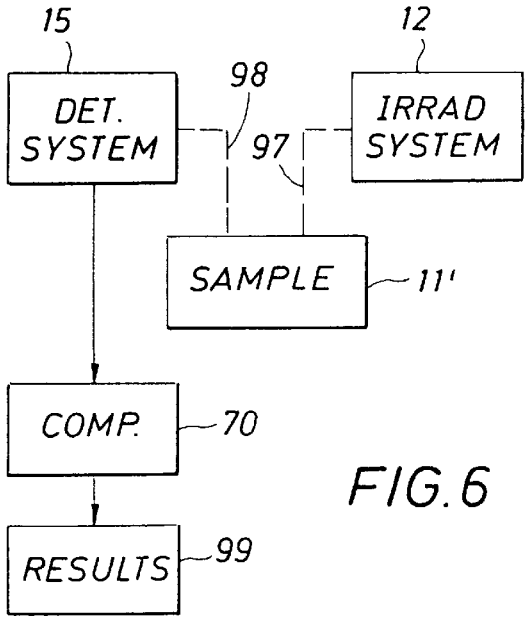
FIG. 6
FIG. 4
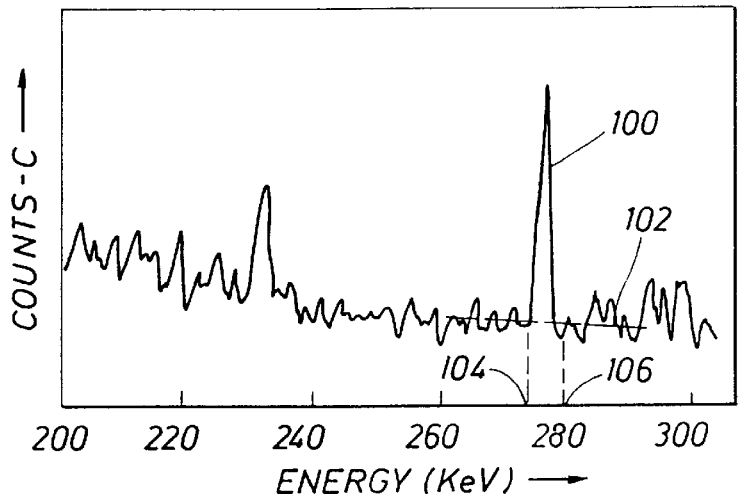
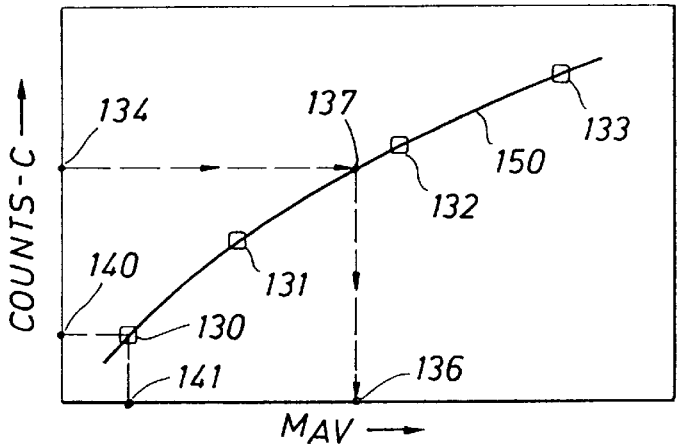
FIG. 5

METHOD AND SYSTEMS FOR GOLD ASSAY IN LARGE ORE SAMPLES

FIELD OF THE INVENTION

The invention relates generally to assaying ore samples for valuable components (assay elements), and more specifically to a technique of assaying large ore samples for gold, silver, and barium content using photon activation analysis.

BACKGROUND OF THE INVENTION

Classical fire assaying is and has remained the standard assay for gold and silver in precious metal mining. In this technique, a small rock sample, typically 30–150 grams (gm) is mixed with litharge (lead oxide) and silica fluxes and fused in a high temperature furnace. A resultant lead button containing solubilized gold and silver is poured into a conical mold. This lead button is subsequently cupeled in a bone ash or other cupel whereby the molten lead is converted to lead oxide which is absorbed by the substance of the cupel. When the cupeling is completed, a small dore bead of gold and silver remains.

This bead is parted in nitric acid to remove the silver after recording the initial weight. The parted bead is weighed again giving the gold weight directly. The silver weight is found by difference of the dore bead weight and the gold bead weight. Alternatively, the dore bead can be dissolved in aqua regia and the resultant solution analyzed on an atomic absorption (A.A.) instrument. The original sample may also be digested in aqua regia to solubilize the gold and silver, and the resultant solution analyzed on an A.A. instrument. In this technique a small sample, typically 10 to 15 grams (gm), is digested in the aqua regia.

Some difficulty is encountered with samples that contain very low quantities of gold and silver. Several samples may be fused and the resultant beads added together to obtain greater sensitivity, but this required more time and extra cost. In addition, very great care is required in temperature control and timing to obtain accurate silver assays. While fire assaying is a very sensitive assay technique for gold particularly, which is why it has been used for such a long time, its sensitivity is limited by the size of bead that can be detected and weighed or solubilized in an A.A. finish. There are some organic solvents, such as M.T.B.K., which can extract gold from an aqueous solution and thus concentrate the gold for greater sensitivity on an A.A. instrument.

Additionally, all of these techniques suffer from allowing only small ore samples to be analyzed. In order for the sample data to be meaningful, the small sample must be representative of the larger and typically non homogeneous rock sample from which it is obtained. To date, the only technique which has allowed this representativeness has been a meticulous sample preparation wherein a large rock sample is crushed into successively smaller sizes before being split into a smaller sample. The final sample is pulverized typically to less than 150 mesh prior to be digested or fused for assay. This meticulous sample preparation is not only expensive, but it can be very difficult to achieve with native gold metallics present. Gold is usually not homogeneously distributed in a sample but occurs most commonly as metallics frequently alloyed with silver. While silver can occur as a native metallic, it is more frequently present with gold as electrum or combined with sulfur as a silver sulfide.

The problems are aggravated when the ore deposits are of low grade. The current price of gold and the development of process and mining technology has allowed the development of large low grade deposits. These deposits typically require much drilling and blasting to break the ore for processing. Large volumes of samples are prepared from these blast holes for assaying to control the mining.

The fire assay technique has remained the standard, and low throughput, low sensitivity for low gold content, and the requirement for meticulous sample preparation have been accepted as inevitable.

In view of the above discussion, and object of the present invention is to provide a system which can assay relatively large samples of ore for gold and other assay elements of interest.

An additional object of the invention is to provide an assay system for certain elements in various environments which requires minimal sample preparation.

Yet another object of the invention is to provide an assay system with throughput which is greater than the prior art fire assay method.

Another object of the invention is to provide an assay system with sensitivity sufficient to meet requirements for commercial ore testing and production standards.

Still another object of the invention is to provide an assay system whose accuracy and precision is not adversely affected by typically non homogeneous ore samples and especially relatively large, non homogeneous samples.

Another object of the invention is to provide an assay system that is relatively insensitive to sample geometry.

Yet another object of the invention is to provide a non destructive assay or analysis system that can be used with a wide variety of sample types to determine the elemental concentration of any element susceptible to detection by means of photon activation.

There are other objects and applications of the invention which will become apparent in the following disclosure.

SUMMARY OF THE INVENTION

The present invention provides a high throughput technique that permits large sampled of materials to be analyzed for their gold, silver, and other assay element contents, thereby avoiding the time and cost necessary for a meticulous sample preparation. The technique is effective even when the distribution of metallics in the sample is not homogeneous.

The present invention departs from the prior art techniques in that it recognizes that certain nuclear physics techniques can yield assay information. Specifically, the invention exploits the properties of certain elements having isotopes with one or more excited nuclear states that are characterized by relatively long half lives (microseconds to minutes). Nuclei in these excited states are referred to as isomers, and cannot be produced directly from the ground state. Rather they must be produced by exciting the nucleus to a higher excited state which quickly decays to the long-lived isomeric state. The isomers decay to the ground state through the emission of a gamma ray having a well defined energy for the particular element. Typical gamma ray energies for isomeric transitions are in the range of 0.05–1.0 million electron volts (MeV) or 50–1000 thousand electron volts (KeV).

The technique of the invention entails irradiating the sample with a beam or flux of gamma rays of sufficient energy to excite the nuclei of the assay elements into their isomeric states, ceasing the irradiation, detecting and identifying the gamma rays resulting from the decay of the isomeric states to the ground state, and the analyzing the detected gamma rays to determine the content of assay elements in the sample. In a preferred embodiment, the irradiated sample is rapidly moved to a shielded low background environment in which the gamma rays from the isomeric transition are detected.

As mentioned previously, the ore samples are typically non homogeneous. As an example, gold ore can contain gold in highly concentrated "nuggets" which are rather sparsely and non homogeneously distributed through a large volume of non gold bearing material. The average gold concentration of such an ore may, however, be well above the commercial threshold. Any meaningful assay system must be able to accurately obtain results for non homogeneous ore. To address this problem, the present invention is embodied so that portions or "segments" of the ore sample are sequentially irradiated and counted. During each irradiation, the sample is oscillated within the gamma ray flux in order to obtain uniform exposure of each portion. After all segments of the sample have been irradiated and counted, the count results are combined in order to obtain a highly representative assay of the entire sample volume.

The technique has a similar sensitivity to gold as fire assay, 0.001 troy ounce per short ton, but can quickly handle large sample weights (typically 10 kg) to give better average assay numbers. The technique makes it possible to process large volumes in a reasonable time (more than 600 samples within 24 hours).

While the nuclear physics phenomena exploited by the invention are known, the present discussion of the physics underlying the invention technique is not intended as an admission that the nuclear physics phenomena were recognized in the prior art as having any applicability to a technique for assaying large ore samples, or having applicability to any other stated objects of the invention.

The system can also be configured to analyze many types of samples non destructively for any element which is subject to photon activation analysis.

BRIEF DESCRIPTION OF THE DRAWINGS

A further understanding of the nature and advantages of the present invention may be realized by reference to the remaining portions of the specification and to the attached drawings, wherein

FIG. 3 is a more detailed view of the detector assembly;

FIG. 4 is a photon activation spectrum, measured with a germanium (Ge) detector, which illustrates the gold peak at 278 KeV;

FIG. 5 illustrates graphically the conversion of measured counts into a gold ore assay using a calibration relationship obtained with samples containing known amounts of gold; and FIG. 6 shows the invention configured to non destructively analyze any type of sample for any element susceptible to photon activation.

DESCRIPTION OF THE PREFERRED EMBODIMENT

The preferred embodiment of the invention will be disclosed in multiple sections which cover the apparatus preferred mode of operation, system calibration and results.

Figures 1A, 1B, 1C:
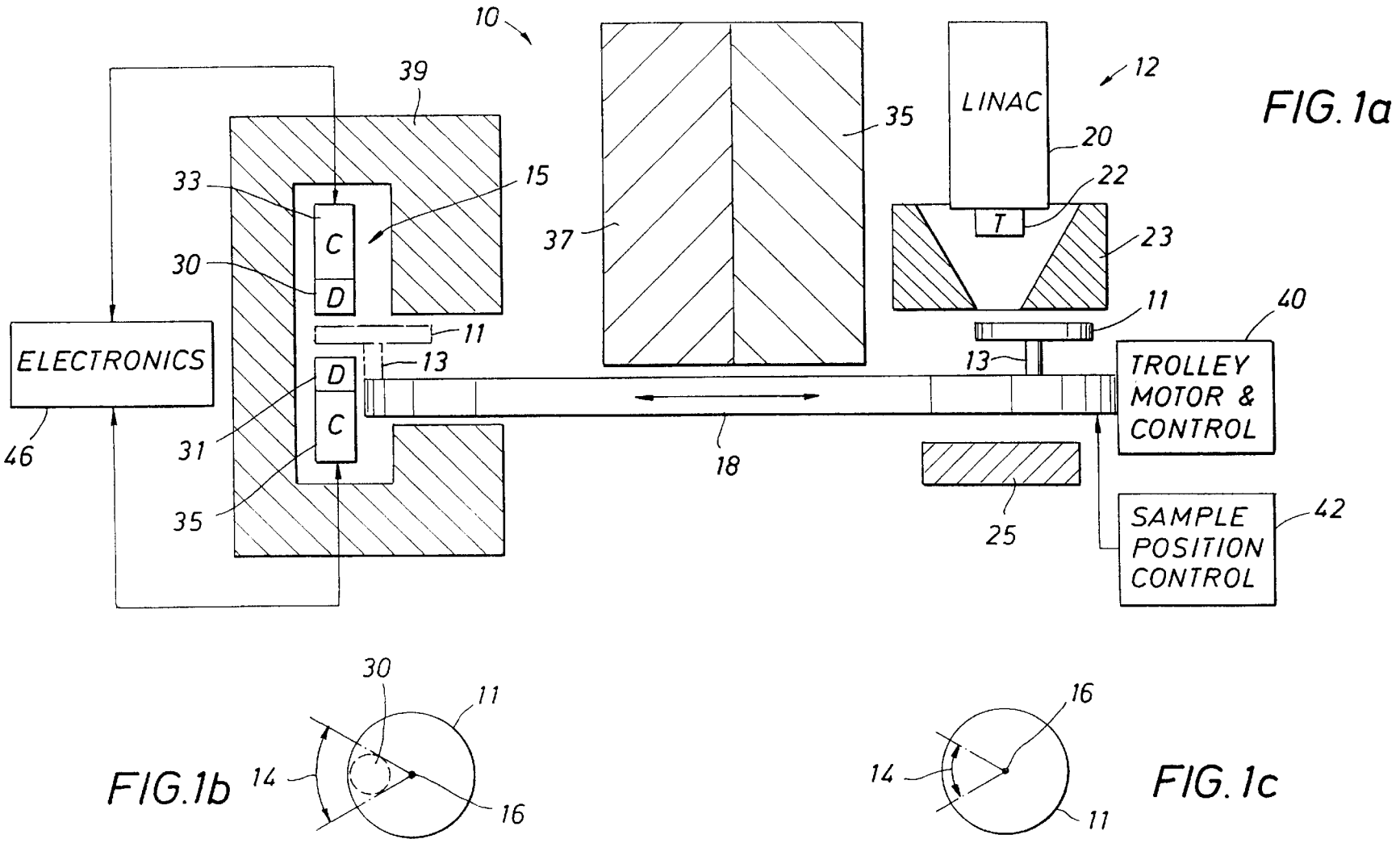
FIG. 1*a* is a schematic side view of the apparatus for practicing the ore assay technique of the present invention.
FIG. 1*b* is a top view of a sample container in an irradiation position.
FIG. 1*c* is a top view of the sample container in a count position.

FIG. 1*a* is a schematic side view of an ore assay apparatus 10 according to the present invention. The system is intended for detecting the presence in a sample 11 of certain assay elements whose nuclei have relatively long-lived isomeric states. The apparatus includes an irradiation system 12 for irradiating the sample, a detector system 15, preferably removed from the vicinity of irradiation system 12, for detecting and quantifying the intensity of characteristic decay products, and a sample transport system 18 for moving the sample. The sample 11 in the irradiation position is drawn in solid lines, and in broken lines as a phantom sample in the detection position.

The sample 11 preferably consists of a cylindrical holder filled with ore of a known weight. Essentially no preparation of the sample, such as drying and crushing, is required. The sample holders or "pans" are preferably filled with ore from a hopper (not shown) and given an identifying mark such as a bar code so that they can be tracked through the assay system. It is preferred that the sample containers be vibrated during filling so that the maximum amount of ore can be effectively "packed" into the sample holder in order to obtain maximum assay sensitivity for given irradiation and count times.

Again referring to FIG. 1*a*, the irradiation system 12 operates to produce a relatively intense beam of gamma rays in the 6–9 MeV energy range. This range of gamma ray energy, while not critical, provides gamma rays of high enough energy to produce significant isomeric excitation, but not so high as to cause photoneutron and photofission processes. The irradiation system 12 preferably includes an electron linear accelerator 20, which is often referred to as a "linac" for brevity. The output beam of the linac 20 impinges upon a target 22 comprising material with a large atomic number Z such as tungsten. This will be referred to as a "high-Z" target. The resultant gamma rays are preferably collimated to a 20–30 degree cone by a conic collimator 23 and directed to the sample 11 and to a beam stop 25. An electron linear accelerator is preferred over an isotopic source of gamma because it produces copious photons, on the order of $10^{15}$ to $10^{16}$ photons/second, which is equivalent to a megaCurie isotopic source, although $^{60}Co$ can be used if other operating conditions are suitable. A suitable linear accelerator is the Linatron Model 3000 manufactured and sold by Varian, Inc.

The sample pan is preferably 12 to 14 inches (30 to 36 centimeters) in diameter, 1 to 3 in. (2.5 to 8 cm) thick, and contains approximately 2–3 liters of ore material. The sample 11 is mounted on a sample positioning apparatus 13 and is only partially exposed to the flux of gamma radiation. Referring to both FIG. 1*a* and to the top view of the sample shown in FIG. 1*b,* a portion or sector of sample, which is preferably defined by a 60 degree arc 14, is oscillated by the sample positioning apparatus 13 about the sample axis 16 during irradiation of this portion of the sample in order to obtain uniform exposure of the portion to the gamma ray flux.

When a portion of the sample 11 has been irradiated for a sufficient length of time, the irradiation system 12 is turned off. As shown in FIG. 1*a,* the sample is then rapidly moved by means of a transportation system 18 or "trolley" to a detector system 15 for analysis. The trolley is operated under the control of a trolley motor and control system 40. Additional details of the irradiation, isomeric excitation, and decay process are provided in a subsequent section of this disclosure entitled "OPERATION". Detector system 15 includes an array of detectors 30 and an array of detectors 31 positioned above and below the sample 11, respectively, so that the irradiated portion defined by the arc 14 is exposed to the top detector array 30 and the lower detector array 31. The relative positions of sample and detector are best shown in FIG. 1*c* and in FIG. 3 which is a top view of the sample/detector geometry. After counting for a sufficient time, the sample is returned to the irradiation position and rotated by the sample positioning apparatus 13, under the control of a sample position control system 42, so that the next sequential portion of the sample 11 is exposed to the gamma ray flux. After irradiation, the sample is again transported by the trolley 18 to the detector system 15 for counting of that irradiated segment. This process is continued until all sample segments have been irradiated and counted. Using segment portions defined by the arc 14 of 60 degrees, the irradiation-count sequence is repeated six times. All counts are then combined to obtain a representative assay of the entire sample 11, as will be detailed in a subsequent section. The segmented irradiation and counting of the sample, and the oscillation of the sample during radiation, not only reduces the adverse effects of sample non homogeneity but also reduces the adverse effects caused by any variation of sample geometry.

Again referring to FIG. 1*a,* each detector array 30 and 31 preferably includes clusters of high resolution germanium (Ge) detectors which are cooled by liquid nitrogen cryostat systems 33 and 35 or another type of electrical or mechanical cooling apparatus, respectfully, with associated electronics 46. Details of the detector system 15 will be presented in subsequent sections of this disclosure. Although high resolution type detectors are preferred, the gamma ray detectors 30 and 31 may be of any type suitable for detecting gamma rays in the range of about 0.05–1.0 MeV which is the range of typical isomeric transitions). An example of an alternate detector would be a sodium iodide scintillation crystal optically coupled to a photomultiplier tube. As an additional alternate, only one gamma ray detector can be used resulting in a loss of detection efficiency. Arrays of liquid nitrogen cooled germanium diode detectors are desirable since they have sufficient energy resolution to resolve gamma radiations with nearly the same energies, such as the gold isomeric photon emission "line" at 279.5 KeV from neighboring thorium line at 278 KeV.

The gamma ray energies and isomeric half-lives for selected elements are set in the table below.

| Element | Energy (KeV) | Half-Life (sec.) |
|---|---|---|
| Gold | 279.5 | 7.2 |
| Silver | 88 & 92 | 42 |
| Barium | 662 | 156 |
| Iridium | 130 | 4.9 |
| Hafnium | 220 | 19 |

Shielding structure is required to prevent neutrons and gamma rays produced at the target 22 from reaching the detectors 30 and 31. This is considered as "background" in the assay process. To this end, a body 35 of low-Z material (such as paraffin) is disposed near the accelerator assembly 12 to thermalize the neutrons, and high Z shielding 37 (such as lead) is disposed between the accelerator assembly 12 and the detector assembly 15. Although the accelerator assembly is preferably constructed from materials such that neutrons are not produced by the photoneutron or photofission processes, there is no assurance that the irradiation of the ore material will not generate neutrons by these processes. The low Z shielding material 35 thermalizes these neutrons and preferably contains materials such as boron to capture the thermal neutrons before they can reach the detector assembly 15. Gamma radiation is obviously generated in the vicinity of the accelerator assembly 12 from electrons impinging upon the target 22, from various photon reactions within the sample and surrounding material, from neutron capture reactions, and from other processes. Most of this gamma radiation is absorbed by the high Z shielding material 37. The detector assembly 15 is shielded by additional high Z gamma ray shielding material 39 to isolate the detectors from naturally occurring gamma ray emitters such as thorium, uranium and potassium isotopes, and from extraneous gamma radiation from the accelerator assembly that might penetrate the shield 37. As an additional background reduction means, cadmium jackets about ⅛-inch thick are placed around each detector cluster to absorb any thermal neutrons not absorbed in the shield 35.

Figure 2:
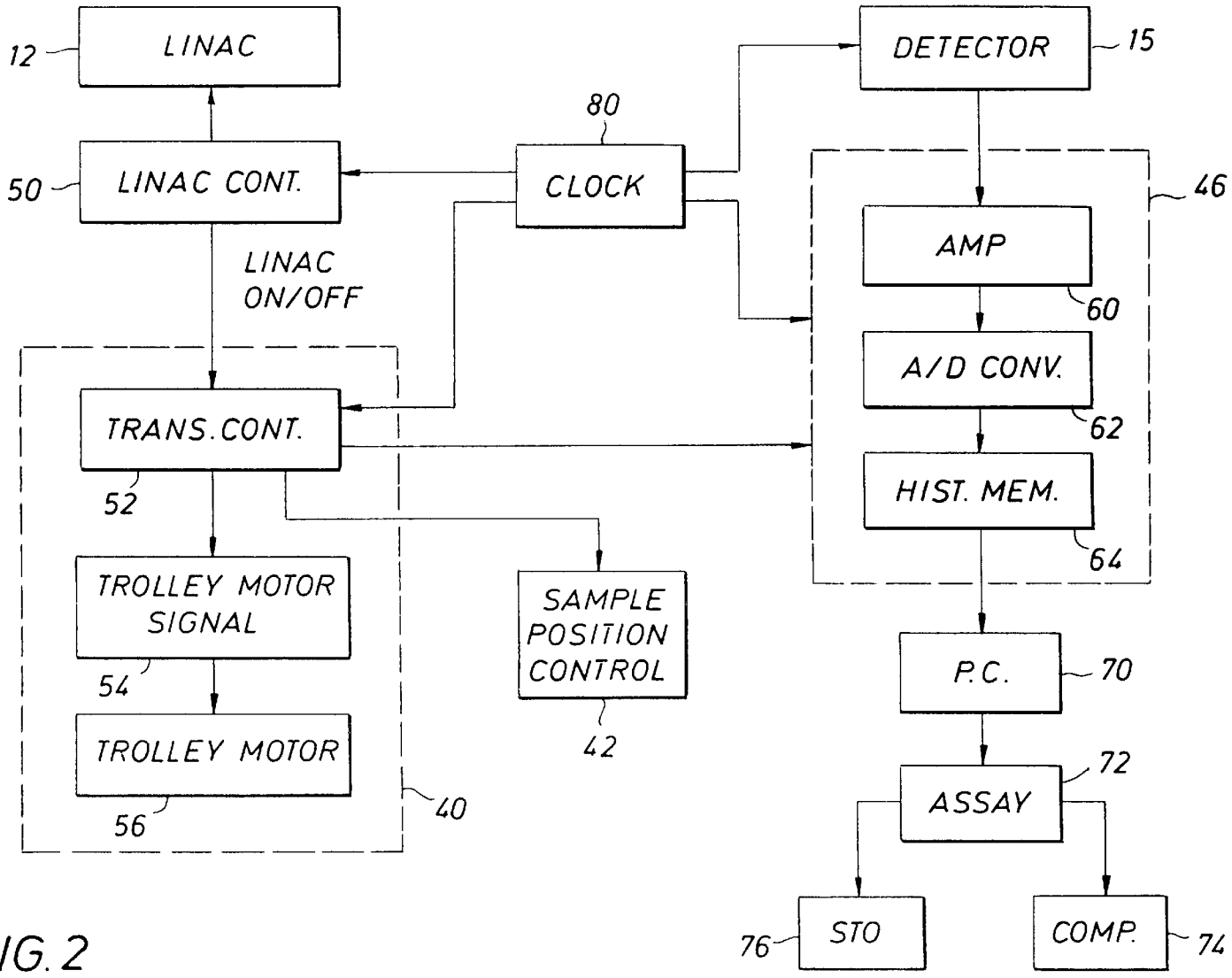
FIG. 2 is a block diagram of system electronics for practicing the technique of the present invention.

FIG. 2 is a functional block diagram of the system. Simply stated, it illustrates means for performing and controlling the sample position, irradiate, count, and count analysis operations previously described. It should be understood, however, that the system can be configured in other ways with other equipment to perform the same basic steps of the invention.

As shown in FIG. 2, a linac controller 40 under the control of a clock 80 initiates and terminates the operation of the linac based accelerator system according to predetermined irradiation and quiescent (or count) times. The clock 80 and the linac controller 50 cooperate with the trolley motor and control system 40 (see FIG. 1*a*) to move the sample 11 to and from the irradiation position and the count position. The trolley motor and control system 40 includes a transport controller 52 which generates a trolley motor signal 54 which, in turn, initiates and terminates a trolley motor 56 thereby conveying the sample to and from the irradiation and the counting position. The transport controller 52 also operates the sample position control 42 thereby positing the sample 11 such that the desired portions defined by the arc 14 are irradiated and counted.

Still referring to FIG. 2, the transport controller 52 and the clock 80 also inhibit and enable the detector electronics and controls 46 so that the irradiated sample is counted at predetermined counting intervals and in a predetermined sequence. Since the detectors produce electronic impulses or "pulses" whose amplitudes are generally proportional to impinging photon energy, a spectrum of measured gamma radiation can be obtained by sorting pulses as a function of amplitude or "height". A peak in the resulting histogram usually indicates monoenergetic gamma radiation of an energy corresponding to that amplitude, and can therefore be used to measure both energy and intensity of impinging gamma radiation. Pulses representative of the energy of gamma radiation impinging upon the detector clusters in the detector system 15 are input into the electronics 46 which comprises an amplifier 60, an analog-to-digital converter 62, and a histogram memory 64. This forms a detected "spectrum" representing a plot of detected gamma ray intensity as a function of gamma ray energy. Functions of the elements 62 and 64 can be performed by commercially available pulse height analyzers. Measured spectra and sample weights are then preferably input into a personal computer (PC) 70 for analysis in which measured intensities of gamma radiation of specific energy are converted into assay concentrations. These assay results can be stored in a storage device or transferred to another computer 74 for additional analysis, combination with assay results from a plurality of other assay systems, and the like.

FIG. 3 illustrates in more detail the arrangement of the gamma ray detector cluster 30 and 31. The top cluster preferably comprises six germanium diode (Ge) detectors. The detectors are preferably the planar type manufactured by Canberra Industries, Inc. Clusters of three Ge detectors 92 are mounted preferably on a common cooling element of a "Trident" cryostat. As shown in FIG. 3 and FIG. 1*a,* six Ge detectors are configured about the arc 14 of sample 11, above the sample, forming the cluster 30. Six Ge detectors configured in the identical geometry are positioned below the sample as cluster 31. This arrangement optimizes the sensitivity of the detector system 15 to activity induced within the sample by the accelerator irradiation system 12.

FIG. 4 is a measured spectrum of counts as a function of photon energy obtained with the Ge detector clusters shown in FIG. 3, showing a representative detector output in a photon range that spans the gold peak identified by the numeral 100 at the characteristic energy of 279.5 KeV. The spectrum is typically a sum of spectra recorded in each of the twelve individual gamma ray detectors and for each of the six sample sectors. The area under the peak 100 is proportional to the intensity of 279.5 KeV gamma radiation impinging upon the detector. This area is determined by subtracting an appropriate "background" level 102 of counts from the total counts recorded in the energy "window" which encompassed the peak 100 from a low energy identified by the numeral 104 to a high energy identified by the numeral 106. Other approaches, such as spectrum fitting, can be used to determine the contribution to the spectrum from the decay of the gold and other isomer. This process is well known in the art and computer software is commercially available to perform such calculations. Energy resolution is of prime importance in obtaining accurate assay results. As given in a previous example, the resolution of the detector system 15 must be sufficient to resolve the desired gold peak 100 from an emission at 277 KeV from naturally occurring thorium which is commonly found in ore.

Additional improvements in the accuracy of the assay measurement can be achieved by removing spectral interference from the detector output by such techniques as assaying a sample devoid of the assay element, but otherwise like the unknown samples, and subtracting the interference from the detector output measured from the unknown sample. Additionally, known spectral response functions of the gamma detector to monoenergetic gamma rays can be used to subtract the background underlying the assay peak using the previously mention methodology of spectrum fitting.

A consistent theme in the design of the assay system 10 is the minimization of background radiation in order to allow detection of the sometimes low intensity of the gamma rays resulting from the isomeric transitions. To this end, those components in the accelerator irradiation system 12 that are exposed to the gamma ray beam are fabricated of materials having an energy threshold for photoneutron production that is greater than the maximum gamma ray energy. This serves to prevent the production of neutrons which can cause neutron activation of the sample and the gamma ray detector. Unfortunately, no such control can be employed over the materials contained within the ore sample and photoneutrons can be produced. The shielding structure serves to prevent nuclear activation of the gamma detectors by those neutrons unavoidably produced in the sample during gamma irradiation. Gamma ray detectors 30 and 31 may also be shielded from any fission-produced delayed neutrons emerging from the sample by surrounding them with a layer of low-z material such as water, plastic, or paraffin.

The steps taken to reduce unwanted background radiation ensure that the signals produced by gamma ray detector assembly 15 result primarily from the gamma rays from the assay elements in the sample. It is also important that the detection and measurement process enhance the desired signal in order to give the maximum sensitivity and accuracy. In this regard, the timing of the overall process is important, and preferably entails irradiation of the sample for the time approximately equal to the half life of the element being assayed. This process may be repeated until the measurement precision is sufficiently high. In such a case, sufficient time must be allowed between successive irradiations so that the activities of other species half lives greater than that of the element being assayed decay to a negligible level.

OPERATION

The operation of the process can be described mathematically using the following relationships between sample activity A and the irradiation time, delay time, and count time. For irradiation that is uniform (or rapidly and uniformly pulsed), the activity builds up during irradiation according to the formula:

$$A=k*I*\sigma*c*(1-\exp(-0.693*T/\tau))/\tau$$

where

A is the activity;

k is the constant depending on the irradiation and target geometry;

I is the current of electrons of energy E striking the target to form the gamma ray beam (the intensity of which is proportional to I);

$\sigma$ is the average activation cross section for an X-ray spectrum with maximum energy E;

c is the concentration of the assay element;

T is the total irradiation time; and $\tau$ is the half-life of the activation product.

After a uniform irradiation, the activity decays exponentially as follows:

$$A=k*I*\sigma*c*(1-\exp(-0.693*T/\tau))/\tau*\exp(-0.693*t/\tau)$$

where t is the time elapsed since the end of irradiation. The gamma rays emitted by the isomers may be uniquely associated with the assay elements by measuring either or both of the gamma ray energy and the decay time of the detected radiation.

Irradiation and count times are selected to yield optimum statistical accuracy of the measurement, while meeting reasonable assay throughput required in commercial applications of the system.

Operation of the assay system 10 is summarized with reference to FIGS. 1*a*, 1*b*, 1*c* and 2.

(1) Sample material is loaded into a sample holder pan 11, and the weight of the sample material is determined.

(2) The sample is placed on the sample position apparatus 13 and oscillated about its axis 16 for 5 seconds while irradiating the first of six sample segments with the accelerator irradiation system 12.

(3) The sample transport trolley 18 is then activated by the trolley motor and controller 40 to move the sample 11 to the detector assembly 15 while maintaining the proper sample orientation.

(4) After a five second count period, the sample position apparatus 13 indexes the sample 11 to the next segmental position, the trolley 18 returns the sample to the irradiation position, and the irradiation-count cycle is repeated until all six sample segments have been irradiated and counted.

(5) Counts and sample weight are transferred to the PC 70 where computer software converts the net counts pertinent to the assay material (e.g. gold) and any significant moisture content measured in the sample into an assay, and also computes the statistical error associated with the assay. If the statistical error is above a predetermined level, the sample may be passed through the irradiation-count cycle again in order to reduce this statistical error.

(6) After assaying, the sample is placed on an output elevating conveyor (not shown) for return to the sample loading area.

(7) Assay results from multiple assays and optionally from multiple assay systems are input into the computer 74 for tabulation and for additional analysis.

It should be understood that the parameters used in the above example are typical and preferred for gold ore assay, but the parameters such as irradiation and count times must be varied with the physical properties of time constants for other elements, as can the volume and dimensions of the sample, without destroying the integrity of the assay system.

CALIBRATION

The system is calibrated by using samples representative of materials such as ores and containing known amounts of assay materials, using gold as an example. It is preferred that these known amounts are of the same orders of magnitudes that are expected from actual assays. It is also preferred that the calibration sample matrix is similar in weight, density, elemental concentration and moisture content to the ore material. The calibration samples are irradiated and counted using the same timing parameters as those used for ore assays.

FIG. 5 is a plot of measured counts, C, in the gold peak as a function of know concentration of gold, $M_{Au}$, in the calibration samples. FIG. 5 is used to graphically illustrate how a calibration relationship or calibration "curve" 150 is obtained by fitting the analysis of four calibration samples, and how this calibration relationship is subsequently used to obtain a quantitative ore assay from measured counts C in the gold peak. The system can be calibrated in any units related to the gold content of the ore, such as counts per ounce/ton, troy ounce per short ton or kilo-rad per oz./ton. The sample containing the lowest concentration 140 of gold yields a count 141 and is plotted as point 130. Results for calibration samples containing progressively higher known concentrations of gold are analyzed and plotted as points 131, 132, and 133, respectively. A curve 150 is then fitted through the four calibration points thereby yielding the desired calibration relationship for the assay apparatus.

RESULTS

The calibration relationship, graphically represented by the curve 150 in FIG. 5, is subsequently used to convert counts from ore samples into assay results. As an example, assume that the ore sample yields a gold count C represented by the point 134. A horizontal line projected from this point intersects the calibration curve 150 at a point 137, and a vertical line projected from the point 137 intersects the abscissa representing $M_{Au}$ at a point 136, thereby yielding the gold content of the ore. It should be understood that the above discussion and FIG. 5 are presented graphically for purposes of illustration, and the actual calibration relationship and assay determination are performed arithmetically in the computer 70.

If the ore and sample calibrations differ significantly in geometry, the resulting assay results must be corrected for changes in irradiation geometry, counting geometry, and sample self absorption of the gold gamma ray emission using techniques known in the art. The ore samples must also be normalized to a weight defined by the calibration relationship as is well known in the art. It is again emphasized, however, that the segmented irradiation and counting of the sample and the oscillation of the sample during irradiation greatly decreases the dependence of the assay system upon sample geometry. Furthermore, if the moisture content or matrix of the calibration and ore samples differ significantly, assay results must be corrected for these factors using techniques known in the art.

ALTERNATE EMBODIMENT

The invention can be embodied to provide a non destructively analysis system for any element which is susceptible to photon excitation and which produces an isotope or an isomer which decay by the emission of radiation which can be identified and quantified. A functional diagram of such an embodiment is shown in FIG. 6. The irradiation and detector systems are again denoted by the numerals 15 and 12, respectfully. In this embodiment, the analyzed sample can be conveyed from the irradiation system 12 to the detector system 15 for counting. An example of such a sample is a piece of metal which is being analyzed to determine its gold content, or silver content, or barium content, or the content of any element susceptible to a photon excitation which yields a decay radiation which can be quantified and identified with the assay element of interest. Alternately, the sample can be left in place, and a representative portion of the sample can be irradiated with the irradiation system, removed after irradiation, and replaced with the detector system 15. An example of such an analysis is an airplane wing, where the irradiation system is placed at a specified spot for irradiation, subsequently removed after irradiation, and replaced at that same spot with the detector assembly 15. The element of interest might be iridium or any other element susceptible to photon activation. Since either the sample 11' can be moved from irradiation assembly to detector, or the sample can remain stationary and the irradiation and detector systems can be interchanged for sample analysis, the functional relationship between these three elements is indicated by the broken lines 97 and 98.

The invention is not limited to photon activation reactions which result in the emission of isomeric gamma radiation. The invention can use any photon activation which results in measurable and identifiable decay radiation from the assay elements of interest. The detectors of the detection system must be selected to optimally detect the decay radiation from the activated assay elements.

Count data from the detector assembly 15 are transferred to the computer 70 where assay concentrations are computed using previously discussed methods. The computer 70 outputs results 99 of the analysis.

SUMMARY

It can be seen that the present invention provides a technique that rapidly and accurately provides assays of large and non homogeneous ore samples with minimal sample preparation compared with methodology of the prior art. The technique has a similar sensitivity to gold as fire assay, less than 0.005 troy ounce per short ton, but can handle large sample weights (typically 10 kg) to give better average assay numbers. The technique makes it possible to process large volumes in a reasonable time (typically 600 samples within 24 hours). Other stated objects of the present invention are also met. While the above is a complete description of the preferred embodiment of the invention, alternative constructions, modifications, and equivalents may be used. For example, it is possible to avoid or reduce the need for neutron shielding around the gamma ray detector if the detector system is located a considerably greater distance from the irradiation system. Some gamma ray absorber is likely to be desirable to reduce naturally occurring background radiation. Furthermore, the irradiation and count scheme can be modified such that, as an example, segments of the sample are irradiated and oscillated while irradiating, but the entire sample is counted rather than counting irradiated segments. In addition, the invention can be configured to analyze any type of sample material for elements susceptible to photon activation analysis.

Therefore, the above description and illustrations should not be seen as limiting the script of the invention which is defined by the appended claims.

What is claimed is:

1. A method of measuring the content, in a sample, of one or more assay elements, comprising the steps:

(a) producing a beam of gamma rays of sufficient energy to excite nuclei of the assay element to an excited state;

(b) irradiating said sample by oscillating said sample within said beam thereby producing said excited state;

(c) detecting radiation resulting from the decay of said excited state; and (d) analyzing said detected radiation to determine the content of assay element in the sample.

2. The method of claim 1 wherein:

(a) said beam of gamma rays is produced by impinging a beam of electrons upon a target;

(b) said assay element is excited to an isomeric state; and (c) said decay radiation is gamma radiation of a characteristic energy resulting from the decay of said excited nuclei to a ground state.

3. The method of claim 2 wherein said sample is conveyed after excitation from operative proximity to said beam of gamma rays to operative proximity for measuring said decay radiation.

4. A method of measuring the content in an ore sample of one or more assay elements characterized by metastable isomeric states, comprising the steps:

(a) producing a beam of gamma rays of sufficient energy to excite nuclei of the assay elements into selected isomeric states;

(b) sequentially irradiating sections of said sample with said beam;

(c) detecting gamma radiation from said sections resulting from the decay of said isomeric states to a ground state; and (d) analyzing said detected gamma radiation to determine the content of assay elements in the sample.

5. The method of claim 4 comprising the additional step of producing said beam of gamma rays by impinging a beam of electrons upon a target interposed in said beam of electrons.

6. The method of claim 5 comprising the additional step, carried out after said irradiating step and before said detecting step, of moving said irradiated sample to shielded environment wherein the detecting step is performed.

7. The method of claim 6 wherein said irradiating step is carried out for a period of time generally commensurate with the half life of one or more of the excited assay elements.

8. The method of claim 6 wherein said ore sample contains one or more of the assay elements selected from gold, silver, barium, iridium, hafnium, or mixtures thereof.

9. The method of claim 6 comprising the additional steps of:

(a) producing said beam of electrons with a linear accelerator; and (b) controlling energy of said beam of electrons so that energy of said beam of gamma rays is below thresholds for production of neutrons by a photoneutron process or by a photofission process.

10. The method of claim 9 wherein said energy of said beam of gamma rays is within the range of about 6 MeV to about 9 MeV.

11. The method of claim 6 including the additional step of shielding said sample from external gamma radiation and external neutron radiation while said sample is within said shielded environment.

12. The method of claim 6 comprising the additional step of shielding said target with an irradiation system shield comprising:

(a) material to thermalize and absorb neutrons; and (b) material to absorb gamma radiation.

13. The method of claim 6 wherein said gamma radiation is detected with a detection system comprising a plurality of gamma ray detectors.

14. The method of claim 13 wherein said detection system comprises a plurality of gamma ray detectors positioned above said sample and a plurality of gamma ray detectors positioned below said sample.

15. The method of claim 14 wherein said gamma ray detectors comprise Ge detectors.

16. A method of measuring the content in an ore sample of one or more assay elements characterized by metastable isomeric states, comprising the steps:

(a) producing a beam of gamma rays of sufficient energy to excite nuclei of the assay elements into selected isomeric states, wherein said beam is produced by impinging a beam of electrons upon a target interposed in said beam of electrons;

(b) irradiating said sample with said beam, wherein said sample is oscillated during said irradiation;

(c) after said irradiating step, moving said irradiated sample to a shielded environment;

(d) detecting within said shielded environment gamma radiation resulting from the decay of said isomeric states to a ground state; and (e) analyzing said detected gamma radiation to determine the content of assay elements in the sample.

17. The method of claim 16 comprising the additional step of irradiating segments of said sample.

18. The method of claim 17 comprising the additional steps of sequentially irradiating and detecting radiation from all of said sample.

19. The method of claim 17 wherein said irradiating step is carried out for a period of time generally commensurate with the half life of one or more of the excited assay elements.

20. The method of claim 17 wherein said ore sample contains one or more of the assay elements selected from gold, silver, barium, iridium, hafnium, or mixtures thereof.

21. The method of claim 17 comprising the additional steps of:

(a) producing said beam of electrons with a linear accelerator; and (b) controlling energy of said beam of electrons so that energy of said beam of gamma rays is below thresholds for production of neutrons by a photoneutron process or by a photofission process.

22. The method of claim 17 wherein said energy of said beam of gamma rays is within the range of about 6 MeV to about 9 MeV.

23. The method of claim 17 including the additional step of shielding said sample from external gamma radiation and external neutron radiation while said sample is within said shielded environment.

24. The method of claim 17 comprising the additional step of shielding said target with an irradiation system shield comprising:

(a) material to thermalize and absorb neutrons; and (b) material to absorb gamma radiation.

25. The method of claim 17 wherein said gamma radiation is detected with a detection system comprising a plurality of gamma ray detectors.

26. The method of claim 25 wherein said detection system comprises a plurality of gamma ray detectors positioned above said sample and a plurality of gamma ray detectors positioned below said sample.

27. The method of claim 26 wherein said gamma ray detectors comprise Ge detectors.

28. The method of claim 17 comprising the additional steps of sequentially irradiating and detecting radiation from all of said irradiated segments of said sample.

* * * * *